US008538040B2

(12) United States Patent
Kirn

(10) Patent No.: US 8,538,040 B2
(45) Date of Patent: Sep. 17, 2013

(54) DRIVERS AND METHODS FOR DRIVING A LOAD

(75) Inventor: Larry Kirn, Austin, TX (US)

(73) Assignee: JM Electronics Ltd. LLC, Wilmington, DE (US)

( * ) Notice: Subject to any disclaimer, the term of this patent is extended or adjusted under 35 U.S.C. 154(b) by 1173 days.

(21) Appl. No.: 12/181,279

(22) Filed: Jul. 28, 2008

(65) Prior Publication Data

US 2009/0003628 A1 Jan. 1, 2009

Related U.S. Application Data

(63) Continuation-in-part of application No. PCT/US2008/052105, filed on Jan. 25, 2008.

(60) Provisional application No. 60/886,746, filed on Jan. 26, 2007.

(51) Int. Cl.
*H04R 3/00* (2006.01)

(52) U.S. Cl.
USPC ..... 381/96; 381/120

(58) Field of Classification Search
USPC ..... 381/94.1–94.3, 120, 55, 56, 98, 101–103, 381/58, 59, 96, 121, 104, 107, 109, 99; 330/298, 297, 278, 279, 265, 284; 379/395.01, 379/395
See application file for complete search history.

(56) References Cited

U.S. PATENT DOCUMENTS

| | | | | |
|---|---|---|---|---|
| 3,769,459 | A * | 10/1973 | Niffenegger et al. | 381/102 |
| 5,543,760 | A * | 8/1996 | Honda et al. | 330/298 |
| 6,580,318 | B2 * | 6/2003 | Taylor | 330/129 |
| 6,687,379 | B1 * | 2/2004 | Thiel | 381/99 |
| 2004/0178852 | A1 * | 9/2004 | Neunaber | 330/284 |

FOREIGN PATENT DOCUMENTS

| | | | |
|---|---|---|---|
| EP | 0 364 930 | A2 | 4/1990 |
| JP | 2001 095080 | | 4/2001 |
| JP | 2001-95080 | * | 4/2001 |

OTHER PUBLICATIONS

International Search Report and Written Opinion, International Application No. PCT/US2008/052105, mailed on Jan. 9, 2008.

* cited by examiner

*Primary Examiner* — Lun-See Lao
(74) *Attorney, Agent, or Firm* — Dorsey & Whitney LLP

(57) ABSTRACT

Embodiments of the present invention provide methods and devices for controlling a command signal applied to a load. In embodiments of the invention, current through and voltage across a load are determined and the values of both are used to generate a hybrid control signal. For example, in some embodiments the hybrid control signal is generated by taking a weighted summation of the current and voltage control signals. In other embodiments, a percentage of the difference between the current and voltage control signals is added to one of the current or voltage control signals to generate the hybrid control signal. In one embodiment, a potentiometer is used to generate the hybrid control signal.

25 Claims, 3 Drawing Sheets

DRIVERS AND METHODS FOR DRIVING A LOAD

CROSS-REFERENCE TO RELATED APPLICATION(S)

This application is a continuation in part of International Application PCT/US2008/052105, with an international filing date of Jan. 25, 2008, which International Application claims the benefit of U.S. Provisional Application No. 60/886,746, filed Jan. 26, 2007. Both previously referenced applications are hereby incorporated by reference in their entirety.

TECHNICAL FIELD

This invention relates to drivers and methods for driving a load such as a loudspeaker.

BACKGROUND OF THE INVENTION

Most audible devices rely upon some form of loudspeaker transducer to transform electrical signals into acoustic waves. These transducers are anything but perfect devices, and introduce numerous forms of distortion into the transformation process. One particularly troublesome characteristic of most loudspeakers is the fact that the impedance is non-linear with respect to both frequency and excitation level. A small variation in the loudspeaker can yield a major variation in perceived performance.

Prior systems utilize either voltage or current control to address the variable impedance presented to a driver by a loudspeaker. However, controlled acoustic power remains an elusive goal. Generally, a loudspeaker transducer's impedance increases as the frequency applied to the transducer decreases. Accordingly, a voltage-controlled amplifier driving a loudspeaker transducer is limited by the increasing impedance in that, below a certain frequency, the current put through the increased impedance is too low to produce acceptable levels of sound. A current-controlled amplifier is able to produce sound at these lower frequency, higher transducer impedance points, but suffers from a risk of ruining the loudspeaker. As the impedance increases and the amplifier continues to put out constant current, the voltage can rise unacceptably high, blowing out the speaker.

Accordingly, an improved method for controlling a signal applied to a loudspeaker transducer is needed.

SUMMARY

Aspects of the present invention relate to methods and devices for controlling a command signal applied to a load. According to one aspect of the present invention, current through and voltage across a load are determined and the values of both are used to generate a hybrid control signal. For example, the hybrid control signal may be generated by taking a weighted summation of the current and voltage control signals. A percentage of the difference between the current and voltage control signals may also be added to one of the current or voltage control signals to generate the hybrid control signal.

DETAILED DESCRIPTION

Embodiments of the present invention provide methods and devices for controlling a command signal applied to a load. While embodiments of the present invention may be advantageously used to control command signals applied to a loudspeaker transducer, it will be appreciated that embodiments of the present invention may be used to control a signal applied to any kind of load, particularly loads presenting a variable impedance to an amplifier. Embodiments of the present invention advantageously combine current and voltage control to generate a hybrid control signal representing aspects of both current and voltage control. For example, in some embodiments the hybrid control signal is generated by taking a weighted summation of the current and voltage control signals. In some embodiments, controlled constant electrical power is applied to the load. Certain details are set forth below to provide a sufficient understanding of embodiments of the invention. However, it will be clear to one skilled in the art that embodiments of the invention may be practiced without various of these particular details. In some instances, well-known circuits, digital blocks, control signals, timing protocols, audio elements, and software operations have not been shown in detail in order to avoid unnecessarily obscuring the described embodiments of the invention.

By applying hybrid control, some embodiments of the present invention advantageously allow for a loudspeaker to reproduce lower frequencies than would be obtainable using either voltage control, where the current through the loudspeaker may become too small to allow for proper operation or current control, where the danger of blowing out the loudspeaker may limit the loudspeaker operation.

Figure 1:
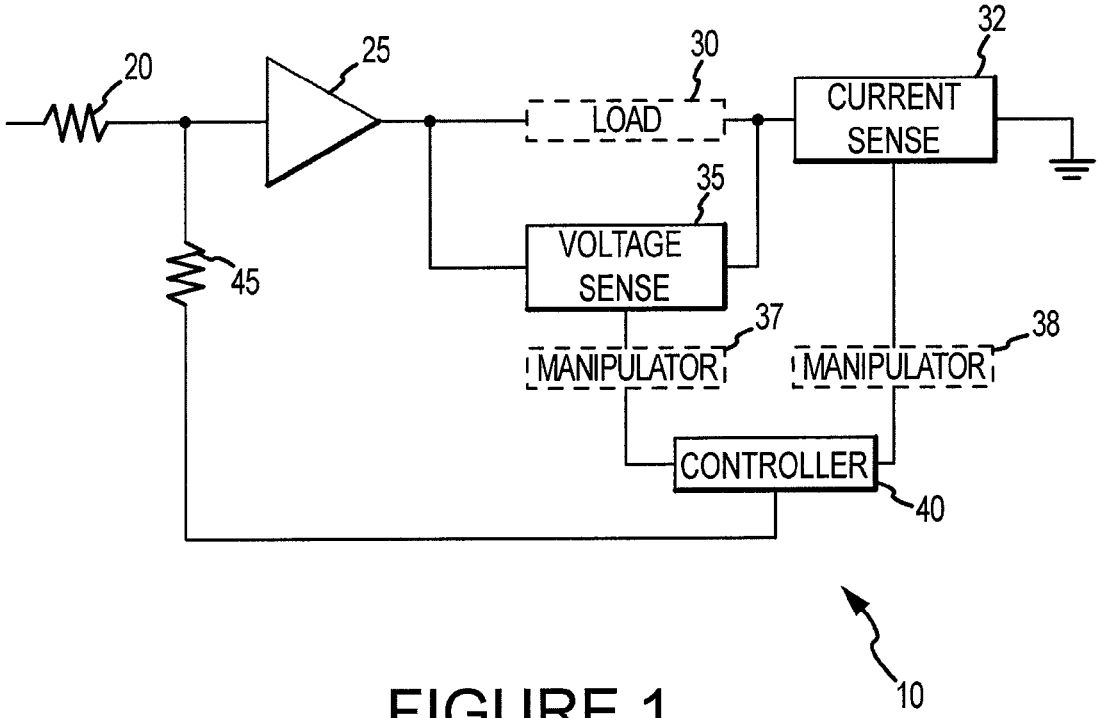
FIG. 1 is a schematic diagram of a driver according to an embodiment of the present invention.

FIG. 1 shows a schematic block diagram of a controlled driver 10 according to an embodiment of the present invention. An input signal is applied to a command resistor 20 and then coupled to an amplifier 25. The amplifier 25 produces a command signal to be applied to a load 30. As described above, the load 30 may include a loudspeaker transducer or other variable impedance load. A current sensor 32 measures a current through the load 30 and develops a current control signal indicative of the current through the load. Although the current sensor 32 in FIG. 1 is shown coupled between the load 30 and ground, it is to be understood that the current sensor 32 may take on a different configuration, or be coupled to a different reference voltage, so long as it produces a current control signal indicative of the current through the load. A voltage sensor 35 measures a voltage across the load 30 and develops a voltage control signal indicative of the voltage across the load. The voltage control signal and the current control signal are both received by a controller 40. The voltage control signal and current control signals may be, for example, voltages or currents. The controller 40 produces a hybrid control signal based on a combination of the voltage control signal and the current control signal. The hybrid control signal is applied to a feedback resistor 45 and ultimately adjusts the command signal applied by the amplifier 25 to the load 30.

The controller 40 may develop the hybrid control signal based on the current and voltage control signals in a variety of ways. If the controller 40 passes the current control signal only, the driver 10 operates as a current controlled driver. If the controller 40 passes the voltage control signal only, the driver 10 operates as a voltage controlled driver. In embodiments of the present invention, the hybrid control signal developed by the controller represents a combination of both the voltage and current control signals. In some embodiments, the controller 40 may be set to take a weighted summation of the current control signal and the voltage control signal to produce the hybrid control signal. In some embodiments, a weighted average may be taken of the current control signal and the voltage control signal. In some embodiments, the controller 40 selects the hybrid control signal to be at some point in between the values of the current control signal and the voltage control signal. That is, the controller 40 selects a point from, for example, 0 to 100 percent between the voltage control signal and the current control signal where, for example, 0 percent represents the current control signal, and 100 percent represents the voltage control signal. Generally, the controller computes a difference between the two signals and adds a certain percentage of that difference on to either the current or voltage controlled signals. Adding 70.7 percent of the difference between the current and voltage controlled signals to the voltage controlled signal will generally yield a controlled constant electric power. In other embodiments, the percentage may be different to achieve a constant power based on irregularities of the amplifier or load. In still other embodiments, a different hybrid combination of current and voltage control is used that may not yield constant electric power. In other embodiments, the percentage is between 0 and 100. In some embodiments, the percentage is 50 percent. In still other embodiments, the percentage is between 20 and 80 percent. Generally, any percentage may be used. The percentage chosen will depend on the desired amplifier performance and the characteristics of the load.

In some embodiments, the method used to combine the current control signal and the voltage control signal is set for the driver 10 and the driver 10 continues to utilize the same combination ratio throughout its operation. In other embodiments, the method for combining the control signals, such as how much each signal is weighted in determining the hybrid control signal, varies according to each application of the amplifier, or indeed in some embodiments is constantly adjusted during operation of the driver 10 according to the desired performance of the amplifier, characteristics of the load 30, and/or characteristics of the audio input signal. In some embodiments, the music genre detection is used to determine how the control signals are combined—classical music may be treated differently than, for example, rap music. Additionally, the current and voltage feedback signals may be independently weighted by frequency in some embodiments. In this manner, one of the voltage or current control signals could be more heavily weighted at certain frequencies to address limitations of the loudspeakers or protect their operation.

The above discussion described a driver according to an embodiment of the present invention that may employ both current and voltage control using a current control signal generated by the current sensor 32 and a voltage control signal generated by the voltage sensor 35. In some embodiments, it may be desirable to manipulate the current or voltage control signal, or both. For example, some applications may have high electromagnetic field (EMF) emissions, such as magnetic actuators. It may be desirable to reduce or eliminate the EMF emissions. Some applications may be resonant systems having high peak-to-average ratios, such as digitally-modulated radio transmitters.

Accordingly, as shown in FIG. 1, manipulators 37 or 38, or both, may be provided to manipulate the current or voltage control signals, or both. The manipulator 37 receives the voltage control signal from the voltage sensor 35 and outputs a manipulated version of the voltage control signal. The manipulator 38 receives the current control signal from the current sensor 32 and outputs a manipulated version of the current control signal. The controller 40 may then generate the hybrid control signal based on a combination of the manipulated voltage control signal and the manipulated current control signal. In this manner, the controller 40 can be set to combine the received current and voltage sense signals in a particular manner, such as to achieve constant power control; however, the current and voltage signals it receives may be previously manipulated by the manipulators 37 and 38 to effect the resultant combination. The manipulators 37 and 38 may manipulate the respective voltage and current control signals according to any variable, including frequency, time, finite state, and the like. Accordingly, one or both of the manipulators 37 and 38 may include any type of filter, as well as one or more attenuators to reduce or block the amplitude of a signal, either entirely or in a frequency-dependent manner.

In one example, the driver 10 may be used to control a system or component having high back electromotive force that runs the risk of damaging the component, such as a magnetic actuator that may be found, for example on an automotive shock absorber. As the controller 40 implements a particular combination of the current and voltage control signals, high force may result if the controller 40 is compensating for a condition that will occur over a fairly long period of time (as opposed to a temporary perturbation of the system). Accordingly, the manipulators 37 and 38 may receive information from other sensors in the system, or they may simply analyze the voltage or current control signals or both to determine a chronic condition exists, and attenuate the magnitude of the current control signal coupled to the controller 40.

In another example, the driver 10 may be used to control a loudspeaker responsive to an input audio signal. Some audio signals will have predictable control issues. For example, a singer having a high-pitched voice may damage a speaker if allowed to continue singing for a prolonged period of time. Accordingly, when the high-pitched singer begins, the manipulators 37 and 38 may initially allow the voltage and current control signals to couple through to the controller 40 as normal. However, after a period of time, the manipulator 38 may attenuate the current control signal applied at the frequencies of concern.

In still another example, the driver 10 may used in resonant systems having high peak-to-average ratios, where peak events occur that consume significantly more power than the average state, such as in CDMA modulation for cell phones. In this example, a peak event may be passed by the manipulators 37 and 38 as normal; however, after a prolonged time, the manipulator 38 may attenuate the current control signal.

As described generally above, information may be shared between the manipulators 37 and 38. The manipulators 37 and 38 may also, or in addition, receive information from other components of the system that can assist in a determination of how or when to manipulate the current and voltage control signals. In some embodiments, one manipulator may be used to manipulate both the current and voltage control signals. Although an analog implementation is shown in FIG. 1, a digital implementation may also be used, including digital filters that may employ algorithms or digital functions for which there is no suitable analog counterpart.

Figure 2:
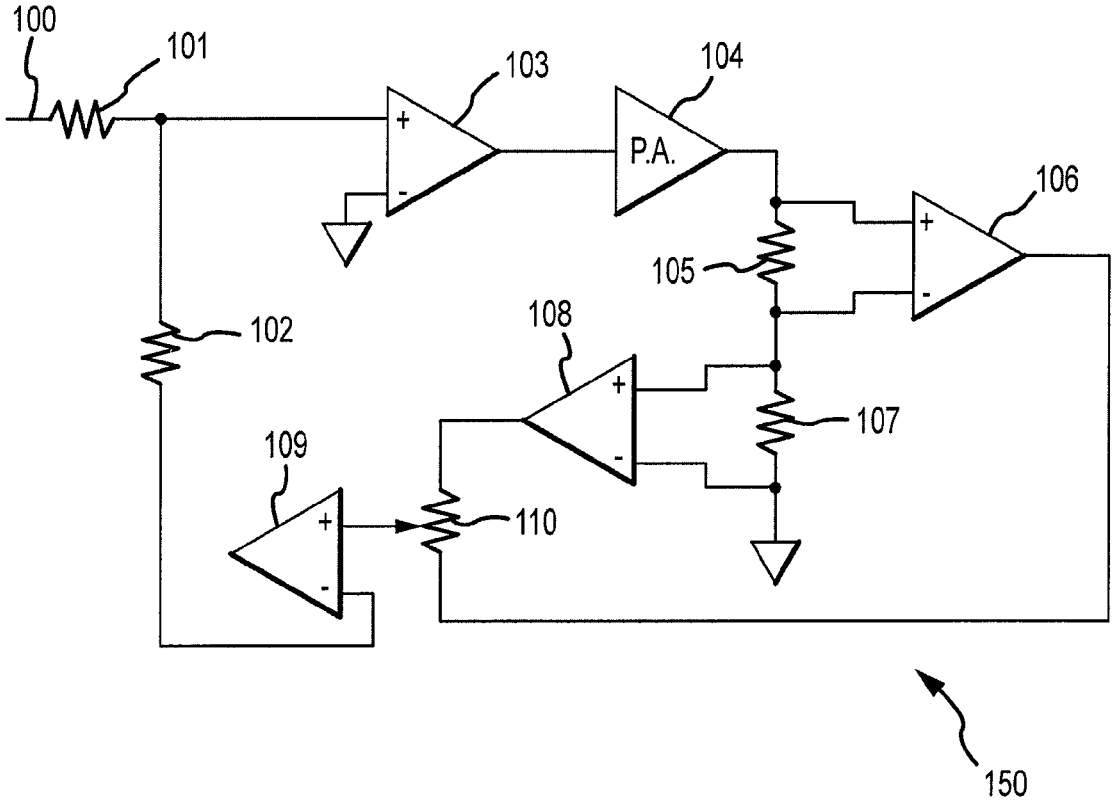
FIG. 2 is a schematic diagram of a driver according to an embodiment of the present invention.

FIG. 2 shows a schematic block diagram of a driver 150 according to an embodiment of the present invention. An input signal 100 is presented to command resister 101 which, in conjunction with feedback resistor 102, controls the output voltage of operational amplifier 103. The output of op amp 103 drives non-inverting power amplifier 104, the output of which is capable of driving an output transducer 107 at the desired power. Although the invention is described in terms of "op amps," other forms of differential amplifiers may alternatively be used, where appropriate. Additionally, various resistive elements used to implement the op amps in FIG. 1 are not shown in the diagram of FIG. 1 to avoid obscuring the disclosed embodiment of the invention.

Power amplifier 104 drives transducer 107 through resistor 105. The resistor 105 is a current sensing resistor and may form part of an embodiment of the current sensor 32 shown in FIG. 10*p* amp 106 may also form part of an embodiment of the current sensor 32 shown in FIG. 1 and converts the voltage drop across 105 (proportional to the current through transducer 107) into a voltage indicative of current through transducer 107. Accordingly, op amp 106 outputs the current control signal. Op amp 108, directly measures the voltage across transducer 107 and is an embodiment of the voltage sensor 35 shown in FIG. 1. Op amp 108 therefore outputs the voltage control signal. The gain of op amp 106 is assumed to be whatever is required to yield the same voltage as is output from op amp 108 when transducer 107 exhibits the expected nominal impedance. In other words, no difference voltage will exist between op amps 106 and 108 when transducer 107 impedance is nominal in the embodiment shown in FIG. 2.

The controller 40 of FIG. 1 is implemented in FIG. 2 as a potentiometer 110 and a voltage follower 109. The outputs of op amps 106 and 108, the current and voltage control signals, each drive one end of potentiometer 110. The wiper of potentiometer 110 drives voltage follower 109, which in turn drives feedback resistor 102. At one end of potentiometer 110 travel, op amp 109 outputs a voltage representative of the voltage across transducer 107 (controlled voltage operation); and at the other end of potentiometer 110, op am 109 will output a voltage representative of the current through transducer 107 (controlled current operation). Due to the equivalent gains of op amps 106 and 108, the position of potentiometer 110 will be inconsequential when transducer 107 impedance is nominal. The potentiometer operates as a voltage divider between the voltage control signal and the current control signal, and positioning the wiper at an appropriate position results in an output hybrid control signal that combines the values of the current and voltage control signals as described above. Accordingly, where 0 represents a position of the wiper yielding constant current control, and 1 represents a position of the wiper yielding constant voltage control, the wiper may be set to any intermediate position to achieve a hybrid control, as described above with reference to percentages.

In that op amp 109 drives feedback resistor 102, overall amplifier loop feedback is therefore continuously variable from voltage to current control by potentiometer 110. Potentiometer 110 may be adjusted from controlled voltage operation, through controlled power operation, to controlled current operation of the amplifier. When adjusted to reflect relative efficiency at the operating points to be linearized, availability of both voltage and current control components allow the present invention to automatically equalize transducer performance. Although an analog implementation is shown in FIG. 2, it should be understood that embodiments of the present invention may be implemented using digital circuits and control blocks as well.

The potentiometer 110 may be set at a particular level for operation of the system in, for example, controlled current, controlled power, or controlled voltage operation, or somewhere in between. In some embodiments, as described above, the potentiometer 110 may be adjusted based on characteristics of the signal applied to the load 30, the load 30 itself, or both. For example, as described above, manipulators may be implemented to effectively change the combination of current and voltage control signals. Operation of the manipulators accordingly may dynamically determine a setting for the potentiometer 110.

The drivers 10 and 150 shown in FIGS. 1 and 2 generally may form part of an amplifier utilized in a loudspeaker system. The drivers 10 and 150 in some embodiments may form a driver for one or more loudspeakers. The drivers 10 and 150 in some embodiments may be included in a pre-driver for an amplifier system, or may reside in a modulator of an amplifier.

Figure 3:
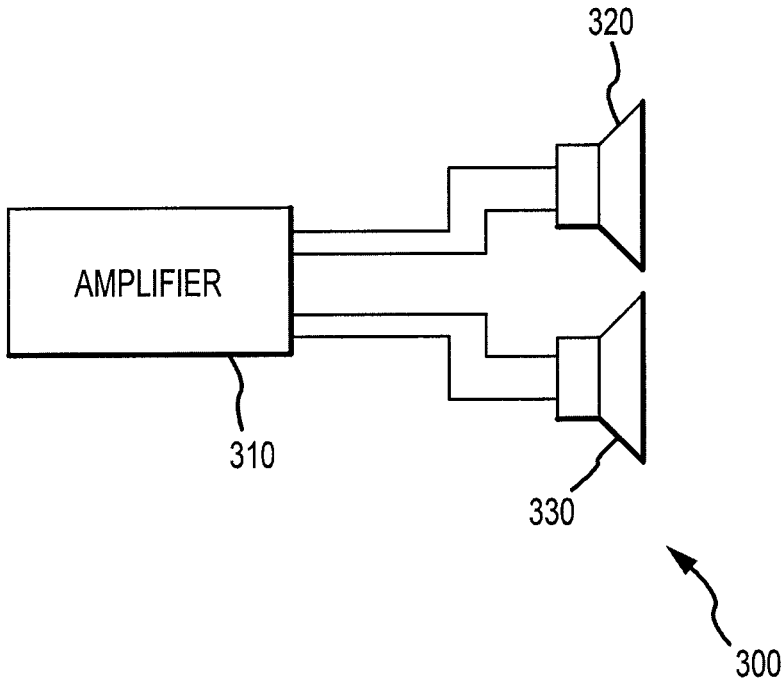
FIG. 3 is a schematic diagram of a system according to an embodiment of the present invention.

A system 300 according to an embodiment of the present invention is shown in FIG. 3. An audio input signal is provided to an amplifier 310, which is configured to drive one or more loudspeakers, such as loudspeakers 320 and 330 shown in FIG. 3. One or more drivers according to an embodiment of the present invention is present in the amplifier 310 to receive the audio signal and drive one or both of the speakers 320 and 330 using the hybrid control methods described above. In some embodiments, however, the hybrid control method is used only to control audio signals corresponding to certain frequencies of the audio input signal, in particular embodiments, to certain low frequencies. While in some embodiments, the hybrid control methods described herein are applied to all frequencies of the audio signal, in some embodiments of the present invention the hybrid control mechanisms are applied selectively to certain frequencies, and in some embodiments lower or bass frequencies. This is because at lower frequencies, the impedance of the loudspeaker may generally be more suitable for hybrid control than at higher frequencies where the impedance curve may be less appropriate.

Accordingly, in some embodiments, the hybrid control techniques described are applied only to portions of an input signal corresponding to frequencies below a threshold frequency. The threshold frequency may generally be between 100 Hz up to about 6 kHz. In one embodiment, the hybrid control methods described are applied to portions of an input audio signal having frequencies at or below 2 kHz.

Loudspeakers may have a crossover frequency specifying the appropriate frequencies within the audio signal for individual transducers to reproduce. For example, in the embodiment of FIG. 3, the transducer 330 may be intended to produce bass sounds, and use of the hybrid control methods described may be advantageous below 200 Hz. The transducer 320 may receive the higher frequency portions of the audio signal and use of the hybrid control methods described may be advantageous at other frequencies for the transducer 320, such as frequencies where the transducer 320 exhibits undesirable impedance variation. In some embodiments, the frequencies at which the hybrid control methods are applied are set based on characteristics of the loudspeaker transducers.

From the foregoing it will be appreciated that, although specific embodiments of the invention have been described herein for purposes of illustration, various modifications may be made without deviating from the spirit and scope of the invention.

What is claimed is:

1. A method of driving a load with an amplifier, the method comprising:

applying a command voltage to the load;

generating a voltage control signal representative of a voltage across the load;

generating a current control signal representative of a current through the load;

manipulating the current control signal in response to detecting a peak in the command voltage to the load, wherein said manipulating produces a modified current control signal;

combining the voltage control signal and the modified current control signal to generate a hybrid control signal, wherein said combining includes calculating a difference between the modified current control signal and the voltage control signal and adding a percentage of the difference to one of the modified current control signal or the voltage control signal to achieve constant power operation, and wherein the percentage is 70.7 percent; and adjusting the command voltage based on the hybrid control signal.

2. The method of claim 1, wherein said manipulating the current control signal comprises attenuating the current control signal.

3. The method of claim 1, wherein said manipulating the current control signal comprises filtering the current control signal.

4. The method of claim 1, further comprising, prior to said combining, manipulating the voltage control signal in response to said detecting a peak in the command voltage to the load.

5. The method of claim 1, wherein said combining comprises taking a weighted summation of the modified current control signal and the voltage control signal.

6. The method of claim 1, wherein said combining comprises generating the hybrid control signal having a value between the modified current control signal and the voltage control signal.

7. The method of claim 1, wherein said combining further comprises:

applying the voltage control signal and the modified current control signal to a potentiometer having a wiper; and setting the wiper based on the percentage.

8. The method of claim 7, wherein the percentage changes over time, and wherein the wiper setting changes as the percentage changes.

9. The method of claim 1, wherein the voltage control signal and the modified current control signal are both voltages, and wherein said combining comprises applying both the voltage control signal and the modified current control signal to a voltage divider.

10. The method of claim 1, wherein the load comprises a loudspeaker.

11. A driver for driving a load, the driver comprising:

a first amplifier configured to apply a command signal to the load;

a voltage sensor configured to generate a voltage control signal indicative of a voltage across the load;

a current sensor configured to generate a current control signal indicative of a current through the load, wherein the current sensor includes:

a resistive element configured to couple between the load and a reference voltage so that a voltage across the resistive element will be indicative of the current through the load; and a second amplifier having a first input terminal, a second input terminal, and an output terminal, wherein the first and second input terminals of the second amplifier are configured to measure a voltage across the resistive element, and wherein the output terminal of the second amplifier is configured to provide the current control signal indicative of the current through the load;

a controller having a first input terminal, a second input terminal, and an output terminal, wherein the controller is configured to:

receive the voltage control signal at the first input terminal;

receive the current control signal at the second input terminal; and generate a hybrid control signal at the output terminal based on both the voltage control signal and the current control signal, and wherein the hybrid control signal is generated to achieve constant power operation; and a feedback device configured to receive the hybrid control signal and modify the command signal based on the hybrid control signal.

12. The driver of claim 11, wherein the reference voltage is a ground.

13. The driver of claim 11, wherein the controller is configured to generate the hybrid control signal having a value between the current control signal and the voltage control signal.

14. The driver of claim 11, wherein the controller is configured to generate the hybrid control signal, at least in part, by taking a weighted summation of the current control signal and the voltage control signal.

15. The driver of claim 11, wherein the controller is configured to generate the hybrid control signal, at least in part, by calculating a difference between the current control signal and the voltage control signal and adding a percentage of the difference to one of the current control signal or the voltage control signal.

16. The driver of claim 15, wherein the controller comprises a potentiometer having a wiper, and wherein the controller is further configured to set the wiper based on the percentage.

17. The driver of claim 16, wherein the percentage changes over time, and wherein the controller is further configured to adjust the wiper setting in accordance with the percentage.

18. A driver for driving a load, the driver comprising:

an amplifier configured to apply a command signal to the load;

a voltage sensor configured to generate a voltage control signal indicative of a voltage across the load;

a current sensor configured to generate a current control signal indicative of a current through the load;

a controller having a first input terminal, a second input terminal, and an output terminal, wherein the controller includes a voltage divider having a first input terminal, a second input terminal, and an output terminal, wherein the voltage divider further comprises a first resistive element between the first input terminal and the output terminal and a second resistive element between the second input terminal and the output terminal, wherein the voltage divider is configured to receive the voltage control signal at the first input terminal, receive the current control signal at the second input terminal, and generate a hybrid control signal at the output terminal, and wherein the hybrid control signal is a voltage between the voltage control signal and the current control signal, and wherein the hybrid control signal is generated to achieve constant power operation; and a feedback device configured to receive the hybrid control signal and modify the command signal based on the hybrid control signal.

19. The driver of claim 18, wherein the hybrid control signal represents the sum of:

a percentage of a difference between the voltage control signal and the current control signal; and one of the current control signal or the voltage control signal.

20. The driver of claim 19, wherein the percentage is 70.7%, and wherein the percentage of the difference is added to the voltage control signal for constant power operation.

21. The driver of claim 19, wherein the voltage divider further comprises a potentiometer having a wiper, and wherein the percentage is set by the wiper.

22. The driver of claim 18, wherein the load comprises a loudspeaker.

23. An audio system, the system comprising:

a loudspeaker; and a driver including:

an amplifier configured to apply a command signal to the loudspeaker;

a voltage sensor configured to generate a voltage control signal indicative of a voltage across the loudspeaker;

a current sensor configured to generate a current control signal indicative of a current through the loudspeaker;

a controller having a first input terminal, a second input terminal, and an output terminal, wherein the controller comprises a voltage divider having a first input terminal, a second input terminal, and an output terminal, wherein the voltage divider further comprises a first resistive element between the first input terminal and the output terminal and a second resistive element between the second input terminal and the output terminal, wherein the voltage divider is configured to receive the voltage control signal at the first input terminal, receive the current control signal at the second input terminal, and generate a hybrid control signal at the output terminal, and wherein the hybrid control signal is a voltage between the voltage control signal and the current control signal, and wherein the hybrid control signal is generated to achieve constant power operation; and a feedback device configured to receive the hybrid control signal and modify the command signal based on the hybrid control signal.

24. The audio system of claim 23, wherein the hybrid control signal represents the sum of:

a percentage of a difference between the voltage control signal and the current control signal; and one of the current control signal or the voltage control signal.

25. The audio system of claim 24, wherein the percentage is 70.7%, and wherein the percentage of the difference is added to the voltage control signal for constant power operation.

* * * * *